US009020169B2

(12) United States Patent
Meskens

(10) Patent No.: US 9,020,169 B2
(45) Date of Patent: Apr. 28, 2015

(54) ADAPTIVE DATA RATE FOR A BILATERAL HEARING PROSTHESIS SYSTEM

(75) Inventor: Werner Meskens, Opwijk (BE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 13/471,897

(22) Filed: May 15, 2012

(65) Prior Publication Data

US 2013/0308804 A1 Nov. 21, 2013

(51) Int. Cl.
*H04R 25/00* (2006.01)

(52) U.S. Cl.
CPC ..... *H04R 25/552* (2013.01)

(58) Field of Classification Search
CPC ..... H04R 25/30; H04R 25/305; H04R 25/35; H04R 25/50; H04R 25/55; H04R 25/558; H04R 25/552; H04R 2225/39; H04R 2225/41
USPC ..... 381/23.1, 56–58, 60, 312–331
See application file for complete search history.

(56) References Cited

U.S. PATENT DOCUMENTS

| | | | | |
|---|---|---|---|---|
| 6,400,727 | B1 | 6/2002 | Lim et al. | |
| 6,839,447 | B2 * | 1/2005 | Nielsen et al. | 381/312 |
| 6,882,711 | B1 | 4/2005 | Nicol | |
| 7,522,657 | B2 | 4/2009 | Ahmed et al. | |
| 7,580,535 | B2 * | 8/2009 | Baechler | 381/315 |
| 8,041,066 | B2 * | 10/2011 | Solum | 381/370 |
| 8,169,938 | B2 * | 5/2012 | Duchscher et al. | 370/310 |
| 2002/0012343 | A1 | 1/2002 | Holloway et al. | |
| 2006/0078140 | A1 * | 4/2006 | Goldstein | 381/312 |
| 2011/0033071 | A1 * | 2/2011 | Larsen | 381/315 |
| 2012/0177235 | A1 * | 7/2012 | Solum | 381/315 |
| 2013/0005285 | A1 * | 1/2013 | Yin | 455/115.1 |

FOREIGN PATENT DOCUMENTS

| | | | | |
|---|---|---|---|---|
| EP | 0516374 | A1 | 7/1991 | |
| EP | 0579269 | A1 | 1/1994 | |
| EP | 1968341 | B1 | 10/2008 | |
| WO | 2009131589 | A1 | 10/2009 | |
| WO | WO 2009/153718 | * | 12/2009 | H04R 25/00 |

OTHER PUBLICATIONS

Shandle, Jack, Cypress Upgrades its 2.4-GHz Anti-Interference Technology; EE Times, http://www.eetimes.com/General/PrintView/4098919; Sep. 19, 2007.

* cited by examiner

*Primary Examiner* — Ahmad F Matar
*Assistant Examiner* — Sabrina Diaz
(74) *Attorney, Agent, or Firm* — McDonnell Boehnen Hulbert & Berghoff LLP

(57) ABSTRACT

Methods, systems, and devices for determining a data rate for a communication between bilateral hearing prostheses are disclosed. A first hearing prosthesis transmits a first signal to a second hearing prosthesis during a first transmission interval. The second hearing prosthesis transmits a second signal to the first hearing prosthesis during a second transmission interval. The first signal includes an indication of a data rate for the second signal.

19 Claims, 8 Drawing Sheets

ADAPTIVE DATA RATE FOR A BILATERAL HEARING PROSTHESIS SYSTEM

BACKGROUND

Individuals who have certain types of hearing loss in both ears may benefit from the use of bilateral hearing prostheses. Depending on the type and the severity of the hearing loss, an individual can employ partially implantable hearing prostheses and/or totally implantable hearing prostheses. Partially implantable medical devices typically include an external component that performs at least some processing functions and an implanted component that at least delivers a stimulus to a body part of a user, such as a cochlea. In the case of a totally implantable medical device, the entire device is implanted in the body of a user.

In a bilateral hearing prosthesis system, a first hearing prosthesis is implanted in the user's right ear, and a second hearing prosthesis is implanted in a user's left ear. The hearing prostheses exchange data to assist in processing a sound so as to allow the user to perceive the sound normally. In additional, the hearing prostheses are often configured to communicate with a remote device that allows an individual to adjust a component or a function of the hearing prostheses.

SUMMARY

A method for conducting bilateral communications between two hearing prostheses is disclosed. In one example, the method includes transmitting a first signal from a first hearing prosthesis to a second hearing prosthesis during a first transmission interval. The method also includes transmitting a second signal from the second hearing prosthesis to the first hearing prosthesis during a second transmission interval. The first signal includes information indicative of the data rate for the second signal.

A system is also disclosed. The system includes a first hearing prosthesis, a second hearing prosthesis, and a remote device. A first communication between the first hearing prosthesis and the second hearing prosthesis is interleaved with a second communication between the first hearing prosthesis and the remote device. The first communication is also interleaved with a third communication between the second hearing prosthesis and the remote device. The data rate of the first communication is determined by the first hearing prosthesis, and the data rate of the first communication is less than both the data rate of the second communication and the data rate of the third communication.

A hearing prosthesis is also disclosed. The hearing prosthesis includes a transceiver and one or more processors. The one or more processors are configured to identify an operating mode for the communications with an additional hearing prosthesis. The one or more processors are also configured to determine a data rate for a next communication cycle with the additional hearing prosthesis that is based on the operating mode. The one or more processors are further configured to transmit a signal to the additional hearing prosthesis via the transceiver during a transmission interval. The signal includes information indicative of the data rate for the next communication cycle.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE FIGURES

Presently preferred embodiments are described below in conjunction with the appended drawing figures, wherein like reference numerals refer to like elements in the various figures, and wherein.

DETAILED DESCRIPTION

The following detailed description describes various features, functions, and attributes of the disclosed systems, methods, and devices with reference to the accompanying figures. In the figures, similar symbols typically identify similar components, unless context dictates otherwise. The illustrative embodiments described herein are not meant to be limiting. Certain aspects of the disclosed systems, methods, and devices can be arranged and combined in a wide variety of different configurations, all of which are contemplated herein.

Figure 1:
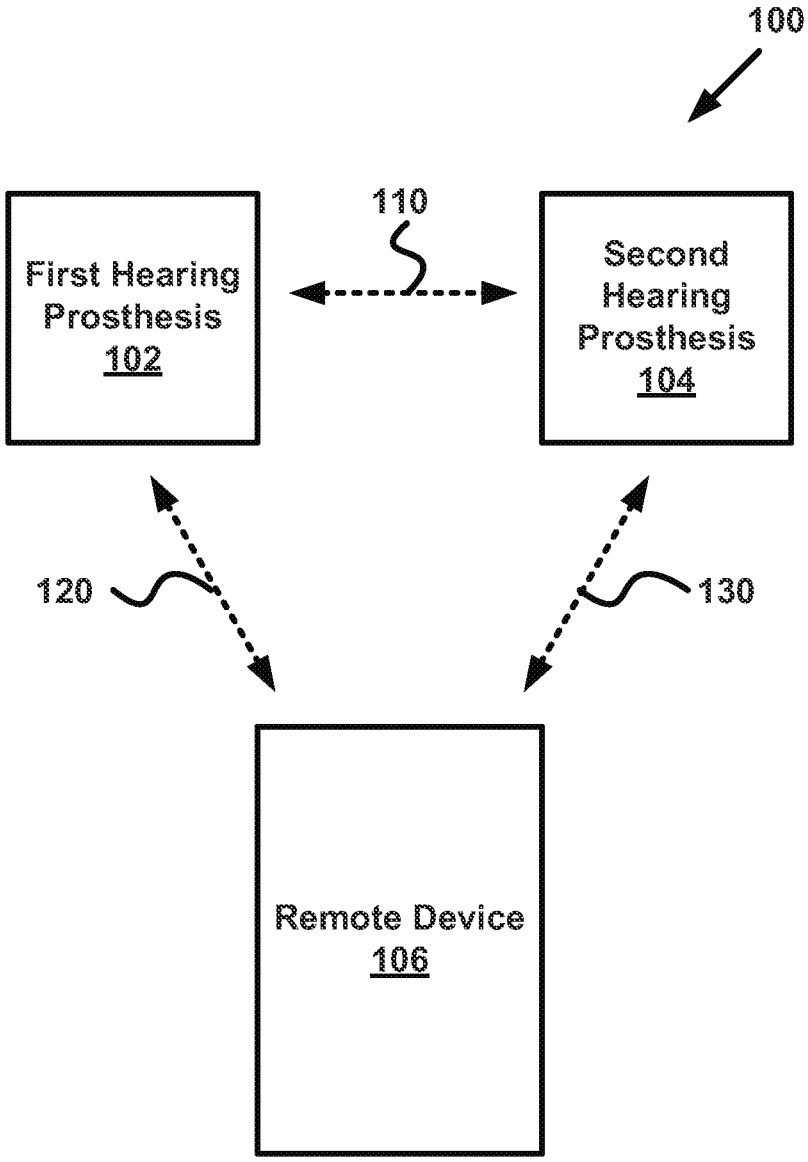
FIG. 1 is a block diagram of a bilateral hearing prosthesis system, according to an example.

FIG. 1 is a block diagram of a bilateral hearing prosthesis system 100. The bilateral hearing prosthesis system 100 includes a first hearing prosthesis 102, a second hearing prosthesis 104, and a remote device 106. In one example, the first hearing prosthesis 102 and/or the second hearing prosthesis 104 are totally implantable cochlear implants. In another example, the first hearing prosthesis 102 and/or the second hearing prosthesis 104 are partially implantable cochlear implants. In yet another example, the first hearing prosthesis 102 and/or the second hearing prosthesis 104 are bone conduction devices, direct acoustic stimulation devices, auditory brain stem implants, or any other hearing prostheses or combination of hearing prostheses now known or later developed that are suitable for use in a bilateral hearing prosthesis system.

Figure 2:
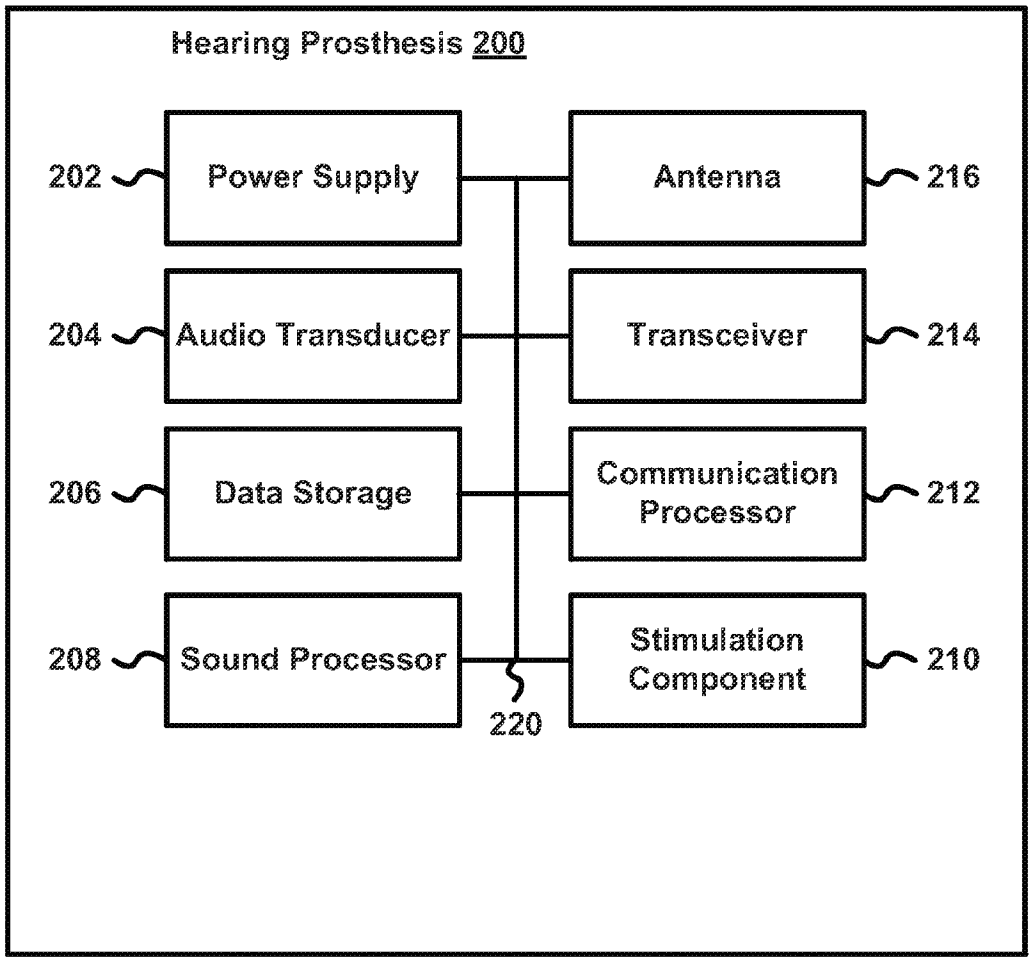
FIG. 2 is a block diagram of a hearing prosthesis depicted in FIG. 1, according to an example.

FIG. 2 is a block diagram of a hearing prosthesis 200. The hearing prosthesis 200 is one example of the first hearing prosthesis 102 and/or the second hearing prosthesis 104 of the bilateral hearing prosthesis system 100 depicted in FIG. 1. The hearing prosthesis 200 includes a power supply 202, an audio transducer 204, a data storage 206, a sound processor 208, a stimulation component 210, a communication processor 212, a transceiver 214, and an antenna 216, all of which may be connected directly or indirectly via circuitry 220.

In one example, the hearing prosthesis 200 is a totally implantable hearing prosthesis, such as a totally implantable cochlear implant. In this example, all of the components of the hearing prosthesis 200 are implanted in a user's body. In another example, the hearing prosthesis 200 is a partially implantable hearing prosthesis, such as a partially implantable cochlear implant. In this example, at least the stimulation component 210 of the hearing prosthesis 200 is implanted in the user's body.

The power supply 202 supplies power to various components of the hearing prosthesis 200 and can be any suitable power supply, such as a non-rechargeable or rechargeable battery. In one example, the power supply 202 is a battery that can be charged wirelessly, such as through inductive charging. Such a wirelessly rechargeable battery reduces the need to access the hearing prosthesis 200 to replace the battery, allowing for implantation of at least a portion of the hearing prosthesis 200. In another example, the power supply 202 is not a replaceable or rechargeable battery and is configured to provide power to the components of the hearing prosthesis 200 for the operational lifespan of the hearing prosthesis 200.

The audio transducer 204 receives a sound from an environment and sends a sound signal to the sound processor 208. In one example, the hearing prosthesis 200 is a cochlear implant, and the audio transducer 204 is an omnidirectional microphone. In another example, the hearing prosthesis 200 is a bone-conduction device, an auditory brainstem implant, a direct acoustic stimulation device, or other hearing prosthesis now known or later developed that is suitable for assisting a user of the hearing prosthesis 200 in perceiving sound. In this example, the audio transducer 204 is an omnidirectional microphone, a directional microphone, an electro-mechanical transducer, or any other audio transducer now known or later developed suitable for use in the type of hearing prosthesis employed. Furthermore, in other examples the audio transducer 204 includes one or more additional audio transducers.

The data storage 206 includes any type of non-transitory, tangible, computer readable media now known or later developed configurable to store program code for execution by the hearing prosthesis 200 and/or other data associated with the hearing prosthesis 200. The data storage 206 stores information indicating a current setting of a parameter of the hearing prosthesis 200, such as a volume setting. The data storage 206 may also store computer programs executable by the sound processor 208 and/or the communication processor 212.

Additionally, the data storage 206 stores data for conducting bilateral communications with an additional hearing prosthesis. In one example, the data stored in the data storage 206 includes at least one of an address for the additional hearing prosthesis, one or more frequencies for communicating with the additional hearing prosthesis, a length of a timing interval for transmitting data to and receiving data from the additional hearing prosthesis, and a data rate used for transmitting data to the additional hearing prosthesis.

The hearing prosthesis 200 is configured to receive signals from a remote device, such as the remote device 106 depicted in FIG. 1. In one example, the data storage 206 stores at least one of an address for the remote device, a frequency for communicating with the remote device, and a length of a timing interval for transmitting data to and receiving data from the remote device. Furthermore, the data storage 206 may store any additional data necessary for conducting communications with the additional hearing prosthesis, the remote device, or another electronic device.

The sound processor 208 receives a sound signal and processes the sound signal into an output signal suitable for use by the stimulation component 210. In one example, the sound processor 208 is a digital signal processor. In another example, the sound processor 208 is any processor now known or later developed suitable for use in a hearing prosthesis. Additionally, the sound processor 208 may include additional hardware for processing the sound signal, such as analog-to-digital converter.

The sound processor 208 receives the sound signal from one of the audio transducer 204 and the communication processor 212. If the sound processor 208 receives the sound signal from the audio transducer 204, the sound signal includes a sound from the environment received by the audio transducer 204. Alternatively, if the sound processor 208 receives the sound signal from the communication processor 212, the sound signal includes a sound received from a remote device, such as the remote device 106 depicted in FIG. 1. For instance, in one example the remote device is configured to stream music to the hearing prosthesis 200. In this example, the sound signal includes an audio signal containing music received from the remote device.

To process the sound signal, the sound processor 208 accesses the data storage 206 to determine a setting of one of a plurality of parameters used for processing the sound signal, such as sensitivity, volume, frequency range, and the like. In one example, the sound processor 208 also executes a program stored in the data storage 206 to process the sound signal.

The sound processor 208 determines an operating mode of the hearing prosthesis 200. The operating mode includes a mode for processing the sound signal. In one example, the sound processor 208 determines an operating mode based on the sound signal. For example, consider a situation where a user of the hearing prosthesis 200 is in a crowded room. The sound processor 208 receives a sound signal from the audio transducer 204 that includes sounds from multiple sound sources. The sound processor 208 determines that the sound signal includes multiple sources. In order to maintain a volume of the sound perceived by the user, the sound processor 208 determines that the operating mode is a fast automatic gain control and processes the sound signal using a fast automatic gain control algorithm. In another example, the sounds processor accesses the data storage 206 to determine a setting for the operating mode. In yet another example, the sound processor 208 receives a signal that includes an indication of the operating mode from a remote device via the communication processor 212.

The stimulation component 210 receives the output signal from the sound processor 208 and converts it into a stimulation signal that is delivered to a body part of a user of the hearing prosthesis 200. In an example where the hearing prosthesis 200 is a cochlear implant, the stimulation component 210 includes an electrode array that is implanted in a cochlea of the user. The stimulation component 210 delivers the stimulation signal to the electrode array. The stimulation signal stimulates a portion of the user's cochlea, which in turn stimulates an auditory nerve of the user, thus allowing the user to perceive the sound.

In another example, the stimulation component 210 stimulates a different body part of the user. For instance, if the hearing prosthesis 200 is an auditory brain stem implant, the stimulation component 210 provides the stimulation signal directly to the user's brain. In this case, the stimulation component 210 includes an electrode array that is implanted in the user's brain. The stimulation signal sent to the user's brain activates at least one of the electrodes, allowing the user to perceive at least a characteristic of the sound.

The communication processor 212 controls the path of signals sent from and received by the hearing prosthesis 200. The communication processor 212 sends an outgoing signal to the transceiver 214 for transmission during a transmit interval and receives an incoming signals from the transceiver 214 during a receive interval. In one example, the communication processor 212 accesses the data storage 206 to obtain information necessary to conduct communications with another device, such as an additional hearing prosthesis or a remote device. The communication processor 212 may also execute a program stored in the data storage 206 in order to conduct communications with another device.

The communication processor 212 transmits data to and receives data from other devices during time intervals. In one example, the communication processor 212 communicates with other devices using a time-division multiple-access ("TDMA") protocol. In another example, the communication processor 212 utilizes one or more communication schemes suitable for use in a bilateral hearing prosthesis system.

The communication processor 212 prepares an outgoing signal for transmission via the transceiver 214. In one example, the communication processor 212 is configured to include a data packet in the outgoing signal. The communication processor 212 includes information such as an address for the recipient in the header of the data packet, and the communication processor 212 includes sound processing data in the payload of the data packet. The sound processing data includes a setting for a parameter used by the sound processor 208 to processes a sound signal, such as a setting for sensitivity, volume, frequency response, and the like. In another example, the communication processor 212 includes information for bilateral communications with the additional hearing prosthesis in the payload of the data packet, such as a data rate for the bilateral communication link, a frequency or frequency hopping scheme for the bilateral communication link, a transmit or receive interval, a time for the next transmission by the additional hearing prosthesis, or any other data used for communicating between the hearing prosthesis 200 and the additional hearing prosthesis via the bilateral communication link.

The communication processor 212 also processes an incoming signal received by the transceiver 214. In one example, the incoming signal includes a data packet. The communication processor 212 processes the data packet by extracting data from the data packet's payload and transfers the payload data to the sound processor 208. Alternatively, the communication processor 212 may store the payload data in the data storage 206. In yet another example, the incoming signal includes data in any form suitable use in a bilateral hearing prosthesis system.

In one example, the communication processor 212 also controls when the transceiver 214 is operational. For instance, the communication processor 212 activates the transceiver 214 by sending a power-on signal to a transmitter component of the transceiver 214 at the beginning of the transmit interval. Once the transmit interval has ended, the communication processor 212 deactivates the transmitter component by sending a power-off signal to the transmitter component. Similarly, the communication processor 212 sends a receiver component of the transceiver 214 a power-on signal at the beginning of a receive interval and a power-off signal at the end of the receive interval.

The transceiver 214 receives a transmit signal from the communication processor 212 and transmits an outgoing signal via the antenna 216. The transceiver 214 also receives an incoming signal via the antenna 216 and sends the incoming signal to the communication processor 212. In one example, the transceiver 214 and the antenna 216 are configured to transmit and receive signals at a frequency in the radio frequency (RF) spectrum, such as a frequency of about 2.4 GHz. In yet another example, the transceiver 214 is configured to transmit and receive signals in any form or medium that is suitable for communication in a bilateral hearing prosthesis system, such as the bilateral hearing prosthesis system 100 depicted in FIG. 1. In this example, the antenna 216 is configured to transmit and receive signals at a frequency at which the transceiver 214 is configured to transmit and receive signals. Alternatively, in an example in which the transceiver 214 is configured to transmit and receive signals in a medium other than the electro-magnetic spectrum, the antenna 216 is replaced with a component suitable for transmitting and receiving signals in the medium.

The transceiver 214 may also include a transmit buffer and a receiver buffer. The communication processor 212 places an outgoing data packet in the transmit buffer, and the transceiver 214 accesses the transmit buffer during a transmit interval in order to transmit the outgoing data packet. Likewise, the transceiver 214 may store an incoming data packet in the receive buffer during a receive interval, in which case the communication processor 212 accesses the receive buffer to process the incoming data packet.

Returning to FIG. 1, the first hearing prosthesis 102 and the second hearing prosthesis 104 communicate via a first communication link 110, which is a wireless communication link. Either of the hearing prostheses 102, 104 can initiate the communications on the first communication link 110; for illustrative purposes, the first hearing prosthesis 102 initiates the bilateral communication link with the second hearing prosthesis 104. The first hearing prosthesis 102 and the second hearing prosthesis 104 transfer information necessary to allow a user of the bilateral hearing prosthesis system 100 to perceive sound normally. In one example, the first hearing prosthesis 102 and the second hearing prosthesis 104 transmit and receive data packets from one another via the first communication link 110. In another example, the first hearing prosthesis 102 and the second hearing prosthesis 104 transmit and receive signals in any form now known or later developed that is suitable for use in the bilateral hearing prosthesis system 100.

In one example, the first hearing prosthesis 102 and the second hearing prosthesis 104 transfer information necessary to synchronize a sound received by each of the hearing prostheses 102, 104. For example, the first hearing prosthesis 102 may send a packet-based transmission to the second hearing prosthesis 104 that includes data for synchronizing a volume setting between the first hearing prosthesis 102 and the second hearing prosthesis 104. Synchronizing the volume settings avoids a situation where the user of the bilateral hearing prosthesis system 100 incorrectly perceives a sound as being louder in one ear than the other ear.

Depending on an operating mode of the hearing prostheses 102, 104, the amount of data transmitted in order to synchronize a setting of a parameter between the hearing prostheses 102, 104 varies. For instance, in an environment in which the amplitude of sound changes rapidly, such as in a crowded room, the hearing prostheses 102, 104 utilize a fast automatic gain control mode to synchronize sounds. When employing the fast automatic gain control mode, the hearing prostheses 102, 104 rapidly exchange data in order to synchronize the volume of stereophonic sounds perceived by the user. In contrast, when the amplitude of sounds in an environment does not change rapidly, the hearing prostheses 102, 104 utilize a slow automatic gain control mode. Since less information is needed to match the amplitudes of signals in an environment in which the sound level is about constant, the hearing prostheses 102, 104 exchange less data when using the slow automatic gain control mode than when using the fast automatic gain control mode.

The first hearing prosthesis 102 and the second hearing prosthesis 104 employ an adaptive data rate for transmissions via the first communication link 110. The adaptive data rate reduces the power and bandwidth consumption of the hearing prostheses 102, 104 by sending fewer packets between the hearing prostheses 102, 104 when less data is needed to synchronize a setting of a parameter of the hearing prostheses 102, 104. The adaptive data rate is further described with respect to FIG. 3.

Figure 3:
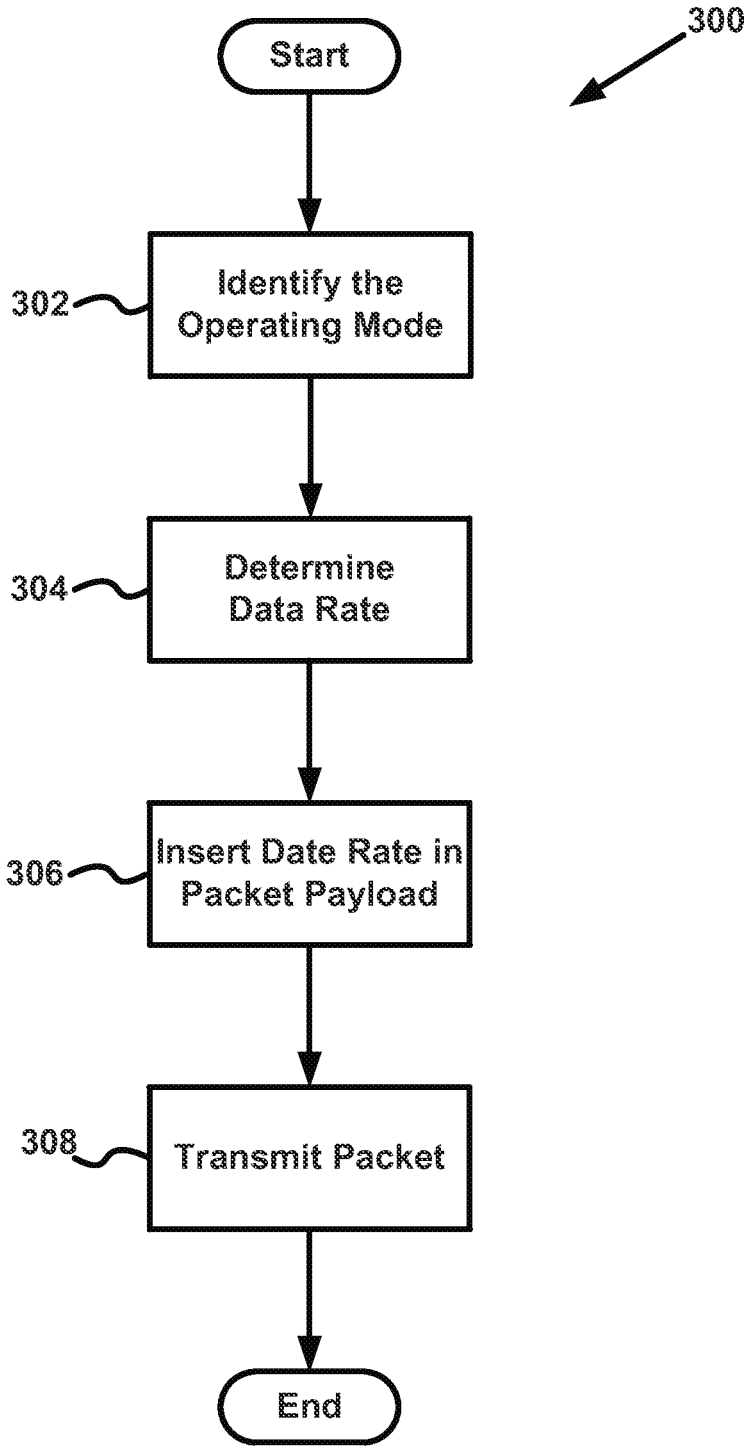
FIG. 3 is a flow diagram of a method for determining a data rate in a bilateral hearing prosthesis system, according to an example.

FIG. 3 is a flow diagram of a method 300. A hearing prosthesis may utilize the method 300 to determine a data rate for communicating with another hearing prosthesis in a bilateral hearing prosthesis system. While the bilateral hearing prosthesis system 100 and the hearing prosthesis 200 are used for purposes of describing the method 300, it is understood that other devices may be used. For illustrative purpose, the first hearing prosthesis 102 determines the data rate for bilateral communications with the second hearing prosthesis 104.

The method 300 may include one or more operations, functions, or actions as illustrated in blocks 302-308. Although the blocks are illustrated in sequential order, these blocks may be performed in parallel and/or in a different order than those described herein. Also, the various blocks may be combined into fewer blocks, divided into additional blocks, and/or removed based upon the desired implementation.

In addition, for the method 300 and other processes and methods disclosed herein, the flow diagram shows functionality and operation of one possible implementation of one example. In this regard, each block may represent a module, a segment, or a portion of program code, which includes one or more instructions executable by a process for implementing specific logical functions or steps in the process. The program code may be stored on any type of computer readable medium, such as a storage device including a disk or hard drive, for example. The computer readable medium may include non-transitory computer readable media, such as a computer readable media that stores data for a short period of time, such as register memory, processor cache, or Random Access Memory ("RAM"). The computer readable medium may also include non-transitory computer readable media suitable as secondary or persistent long term storage, such as read-only memory ("ROM"), one time programmable memory (OTP), or the like. The computer readable medium may also include any other volatile or non-volatile storage systems. The computer readable medium may be considered computer readable storage medium, for example, or a tangible storage device.

In addition, for the method 300 and other processes and methods discussed herein, each block of FIG. 3 may represent circuitry that is wired to perform the specific logical functions of the process.

At block 302, the method 300 includes a hearing prosthesis, such as the first hearing prosthesis 102, identifying an operating mode. The sound processor 208 of the first hearing prosthesis 102 identifies the operating mode and may use the operating mode to perform the steps of additional blocks of the method 300. In one example, the sound processor 208 stores the operating mode in the data storage 206. The operating modes include a fast automatic gain control mode, a slow automatic gain control mode, a telephone mode, a streaming mode, and any other mode suitable for use in processing a sound by a hearing prosthesis. In yet another example, the sound processor 208 sends a signal indicative of the operating mode to another component of the first hearing prosthesis 102, such as the communication processor 212.

In one example, the first hearing prosthesis 102 receives a sound from an environment via the audio transducer 204. The sound processor 208 of the first hearing prosthesis 102 receives a sound signal from the audio transducer 204 and processes the sound signal. In processing the sound signal, the sound processor 208 identifies the operating mode suitable for synchronizing a parameter of the output signal sent to the stimulation component 210 of the first hearing prosthesis 102 and the stimulation component 210 of the second hearing prosthesis 104.

For instance, consider a situation in which a user of the bilateral hearing prosthesis system 100 is in a music hall listening to a symphony perform music. While the symphony is playing, the sound processor 208 of the first hearing prosthesis 102 determines that the amplitude of sound signals received from the audio transducer 204 is about constant. Since the amplitude of the sound signals does not change, the sound processor 208 determines that a slow automatic gain control algorithm is suitable for synchronizing the volume of the first hearing prosthesis 102 and the second hearing prosthesis 104. When the symphony completes a piece, the audience applauds, causing a sharp increase in the amplitudes of sound signals received by the sound processor 208. In this case, the sound processor 208 identifies the operating mode as a fast automatic gain control mode.

In another example, the user of the bilateral hearing prosthesis system 100 talks on a telephone. The sound processor 208 of the first hearing prosthesis 102 determines that the user has placed the telephone near an ear in which the first hearing prosthesis 102 is implanted. The sound processor 208 makes this determination by comparing a sound signal received from the audio transducer 204 with data received from the second hearing prosthesis 104; since the speaker of the telephone is not placed near the second hearing prosthesis 104, the second hearing prosthesis 104 will not receive a sound from the telephone, and the data sent from the second hearing prosthesis 104 to the first hearing prosthesis 102 via the first communication link 110 will not include data correlating to a sound emanating from the telephone. In this example, the sound processor 208 of the first hearing prosthesis 102 identifies the operating mode as a telephone mode.

At block 304, the method 300 includes a hearing prosthesis, such as the first hearing prosthesis 102, determining a data rate for bilateral communications with an additional hearing prosthesis, such as the second hearing prosthesis 104. The data rate for communications via the first communication link 110 is based on the operating mode identified in block 302. When the sound processor 208 identifies the operating mode as the fast automatic gain control mode, more data is transferred between the first hearing prosthesis 102 and the second hearing prosthesis 104 in order to synchronize the volume of sounds perceived by the user of the bilateral hearing system 100, as compared to amount of data transferred between the first hearing prosthesis 102 and the second hearing prosthesis 104 when utilizing the slow automatic gain control mode.

For instance, the data rate for the fast automatic gain control is X, and the data rate for the slow automatic gain control is Y, where X>Y. In one example, the data rate for the slow automatic gain control mode is about 250 bits per second, and the data rate for the fast automatic gain control mode is about 4000 bits per second. In another example, other data rates are used for the slow automatic gain control mode and the fast automatic gain control mode.

In some applications, data is not exchanged between the first hearing prosthesis 102 and the second hearing prosthesis 104. For example, when the operating mode of one of the hearing prostheses 102, 104 is a telephone mode, one of the hearing prostheses 102, 104 does not receive a sound signal from the telephone's speaker. In this example, there is no sound to synchronize between the first hearing prosthesis 102 and the second hearing prosthesis 104, and the data rate is about zero bits per second.

In another example, the first hearing prosthesis 102 and the second hearing prosthesis 104 may receive an audio stream from a remote device, such as the remote device 106 depicted in FIG. 1. In this example, the remote device 106 controls the amplitude of the signals processed by the hearing prostheses 102, 104, removing the need to synchronize the sounds between the first hearing prosthesis 102 and the second hearing prosthesis 104.

The hearing prostheses 102, 104 may conduct packet-based communications on the first communication link 110. In one example, the hearing prostheses 102, 104 are configured to transfer a data packet using a fixed symbol rate, such as a symbol rate of about 250,000 symbols-per-second. In this example, data rate of the bilateral communication link 110 depends on a number of data packets transmitted between the hearing prostheses 102, 104; the higher the data rate, the greater the number of data packets sent during each burst (i.e., transmission of data).

In another example, the hearing prostheses 102, 104 are configured to transfer a fixed number of data packets per second. In this example, the symbol rate of the bilateral communication varies depending on the data rate required for a communication; the higher the data rate, the greater the symbol rate. In yet another example, the symbol rate and the number of data packets vary depending on the bilateral communicating mode determined by the sound processor 208 of the first hearing prosthesis 102.

In the bilateral hearing prosthesis system 100, a component of the first hearing prosthesis 102 determines the data rate and, in some examples, stores the data rate in the data storage 206 of the first hearing prosthesis 102. In one example, the data storage 206 of the first hearing prosthesis 102 stores a plurality of data rates corresponding to a plurality of operating modes. A component of the first hearing prosthesis 102, such as the sound processor 208 or the communication processor 212, accesses the data storage 206 to retrieve the data rate from the plurality of data rates that corresponds to the identified operating mode. In another example, the data storage 206 may include a software program designed to determine the data rate, and the component of the first hearing prosthesis 102, such as the sound processor 208 or the communication processor 212, may execute the software program to determine the data rate based on the operating mode. In yet another example, one of the sound processor 208 and the communication processor 212 is configured to determine the data rate based on the operating mode without accessing the data storage 206.

At block 306, the method 300 includes a hearing prosthesis, such as the first hearing prosthesis 102, inserting a data rate in a payload of a data packet. The first hearing prosthesis 102 inserts the data rate in a payload of a control data packet. The control data packet is the first data packet transmitted to the second hearing prosthesis 104 during a transmit interval for the first hearing prosthesis 102. In one example, the communication processor 212 accesses the data storage 206 to retrieve information necessary for building a data packet, including the data rate. In another example, the communication processor 212 receives a signal from the sound processor 208 that is indicative of the data rate for the first communication link 110.

At block 308, the method 300 includes a hearing prosthesis, such as the first hearing prosthesis 102, transmitting a data packet that includes a data rate for a next communication cycle. In one example, the communication processor 212 assembles the control data packet and additional data packets just prior to or during a transmit interval. In this example, the transceiver 214 transmits the control data packet upon receiving the control data packet from the communication processor 212. In another example, the communication processor 212 assembles the control data packet at any time. In this example, the control data packet is placed in a transmit buffer of the transceiver 214, and the control data packet is the first data packet transmitted during a next transmit interval. After block 308, the method 300 ends.

Returning to FIG. 1, the first hearing prosthesis 102 may include additional data for communicating via the first communication link 110 in the payload of a data packet sent to the second hearing prosthesis 104. In one example, the additional data includes a frequency for the next transmission by the first hearing prosthesis 102. In this example, a data storage of the first hearing prosthesis 102, such as the data storage 206, stores a routine for shifting frequencies. A component of the first hearing prosthesis 120, such as the sound processor 208 or the communication processor 212, accesses the routine and determines the frequency for the next communication cycle.

The first hearing prosthesis 102 and the second hearing prosthesis 104 also communicate with the remote device 106. In one example, the remote device 106 is an electronic device that provides control commands to the hearing prostheses 102, 104. In this example, the remote device 106 allows a user of the remote device 106 to adjust a setting of a parameter of at least one of the hearing prostheses 102, 104. For instance, if the user may select a volume setting for the hearing prostheses 102, 104 on the remote device 106, the remote device 106 transmits a signal that includes the volume setting to the hearing prostheses 102, 104. Additionally, the first hearing prosthesis 102 may receive a value of the frequency for the next transmission from the remote device 106. In another example, the remote device 106 is an audio device that transmits an audio signal to the hearing prostheses 102, 104. For example, if the remote device 106 includes a music player, the signal sent from the remote device 106 to the hearing prostheses 102, 104 includes an audio signal. Furthermore, the remote device 106 may continuously stream the audio signal to the hearing prostheses 102, 104.

The remote device 106 communicates with the first hearing prosthesis 102 and the second hearing prostheses 104 via a second communication link 120 and a third communication link 130, respectively. In one example, the second communication link 120 and the third communication link 130 are wireless communication links. In one example, the remote device 106 sends and receives signals in the RF spectrum, such as at a frequency of about 2.4 GHz. In another example, the remote device 106 sends and receives signals signal in any form or medium that is suitable for communication in the bilateral hearing prosthesis system 100. In yet another example, the remote device 106 communicates with one of the hearing prostheses 102, 104 via a wired communication link.

To avoid interference, the first communication link 110 has a first frequency, the second communication link 120 has a second frequency, and the third communication link 130 has a third frequency. In one example, M frequencies are available for communications on the first communication link 110, the second communication link 120, and the third communication link 130, where M is an integer. The first frequency, the second frequency, and the third frequency are determined at the point of manufacture of the hearing prostheses 102, 104 and the remote device 106. In another example, the remote device 106 is configured to determine the at least the second frequency and the third frequency. In an additional example, the first hearing prosthesis 102 is configured to determine the first frequency. In yet another example, a subset of N frequencies of the M frequencies is reserved the first frequency. In this example, the first the first hearing prosthesis 102 selects one of the N frequencies as the first frequency. The first hearing prosthesis may determine of which of the N frequencies to select by employing a frequency-hopping scheme or by executing a computer program.

The symbol rate of the first communication link 110 is less than the symbol rate of the second communication link 120 and the third communication link 130. In one example, the symbol rate of the first communication link is about 250,000 symbols per second, whereas the symbol rate of the second communication link 120 and the third communication link 130 is about 2,000,000 symbols per second.

Communications between the first hearing prosthesis 102 and the second hearing prosthesis 104 via the first communication link 102 are interleaved with communications between the remote device 106 and the hearing prostheses 102, 104 via the second communication link 120 and the third communication link 130.

Figure 4:
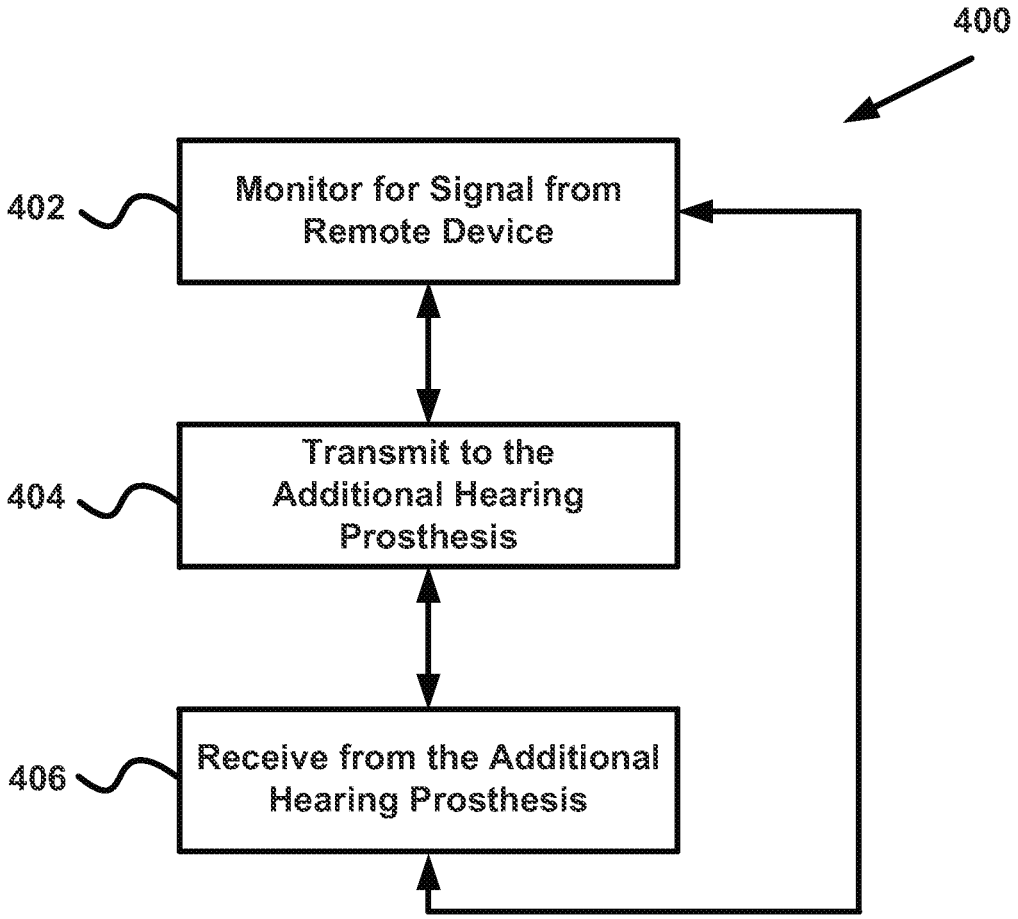
FIG. 4 is a flow diagram of a method for transmitting and receiving communications by a hearing prosthesis, according to an example.

FIG. 4 is a flow diagram of a method 400. A first hearing prosthesis, such as one of the hearing prostheses 102,104 depicted in FIG. 1, may use the method 400 to conduct interleaved communications with a second hearing prosthesis and a remote device. The method 400 may include one or more operations, functions, or actions as illustrated in blocks 402-408. Although the blocks are illustrated in sequential order, these blocks may be performed in parallel and/or in a different order than those described herein. Also, the various blocks may be combined into fewer blocks, divided into additional blocks, and/or removed based upon the desired implementation.

At block 402, the method 400 includes the first hearing prosthesis monitoring for a remote signal from a remote device. The first hearing prosthesis may monitor for the remote signal during a first monitoring interval. In one example, the first monitoring interval is about 32 msec. In another example, the first monitoring interval is any time period suitable for receiving a signal from the remote device. Additionally, a previously received remote signal may include a value of time for the first monitoring interval.

In one example, the first hearing prosthesis monitors for the signal during a portion of the first monitoring interval. For instance, if the first monitoring interval is about 32 msec, the first hearing prosthesis may monitor for the remote signal for a period of about 1,024 μsec. In another example, the first hearing prosthesis monitors for the remote signal for a longer or a shorter portion of the first monitoring interval. Alternatively, the first hearing prosthesis may continuously monitor for the remote signal during the first monitoring interval. In another example, the first hearing prosthesis is also configured to transmit an acknowledgement signal to the remote device upon receiving the remote signal during the first monitoring period.

At block 404, the method 400 includes the first hearing prosthesis transmitting a first bilateral signal to the second hearing prosthesis. In one example, the first bilateral signal includes one or more data packets. In another example, the first bilateral signal includes data in any form now known or later developed suitable for use in a bilateral hearing prosthesis system.

The first hearing prosthesis transmits the first bilateral signal during a transmission interval. In one example, the value of the transmission interval is fixed at a point of manufacture of the first hearing prosthesis. In another example, the value of the transmission interval is included in a signal received from the remote device. In yet another example, the value of the transmission interval is included in a signal received from the second hearing prosthesis.

The first hearing prosthesis may transmit the first bilateral signal during a portion of a transmit interval. In one example, the transmit interval is about 32 msec, and the first hearing prosthesis transmits for about 512 μsec. In another example, the first hearing prosthesis may transmit the first bilateral signal for any portion of the transmit interval that is suitable for bilateral communications in the bilateral hearing prosthesis system.

At block 406, the method 400 includes the first hearing prosthesis receiving a second bilateral signal from the second hearing prosthesis. In one example, second bilateral signal includes one or more data packets. In another example, the second bilateral signal includes data in any form now known or later developed that is suitable for use in a bilateral hearing prosthesis system.

The first hearing prosthesis receives the second bilateral signal during a receive interval. In one example, the value of the receive interval is fixed at the point of manufacture of the hearing prosthesis. In another example, the value of the receive interval is included in a signal received from the remote device. In yet another example, the value of the transmission interval is included in a signal received from the second hearing prosthesis.

The first hearing prosthesis may receive the second bilateral signal during a portion of the receive interval. The timing of the receive interval is synchronized with a transmit interval of the second hearing prosthesis to maximize the probability of the first hearing prosthesis receiving the second bilateral signal during the receive interval. In one example, the receive interval is about 32 msec, and the first hearing prosthesis attempts to receive the signal during a period of about 1,024 μsec. In another example, the first hearing prosthesis may attempt to receive the second bilateral signal for any portion of the receive interval that is suitable for bilateral communications in a bilateral hearing prosthesis system.

After block 406, a first cycle of the method 400 is completed. In one example, the method 400 includes performing a second cycle by returning to block 402. While the method 400 is described sequentially, in another example the first hearing prosthesis performs the method 400 in reverse order, as indicated by the double arrows connecting blocks 402, 404, and 406. In another example, the first hearing prosthesis performs more than one iteration of the steps of one or more of the blocks 402, 404, and 406 in a cycle of the method 400.

Returning to FIG. 1, the first hearing prosthesis 102 may determine a change in the bilateral data rate of each bilateral signal sent between the hearing prostheses 102, 104. In one example, the first hearing prosthesis 102 changes the data rate by changing length of the payload of a data packet transmitted in each bilateral signal. For instance, if a first data rate of a first bilateral signal is less than a second data of a second bilateral signal, a first payload length of a data packet transmitted in the first bilateral signal is less than a second payload length of a data packet transmitted in the second bilateral signal. Consequently, a first amount of time to transmit the first bilateral signal is less than a second amount of time to transmit the second bilateral signal. In contrast, if the second data rate is less than the first data rate, the second bilateral signal will take less time to transmit than the first bilateral signal.

Figure 5A:
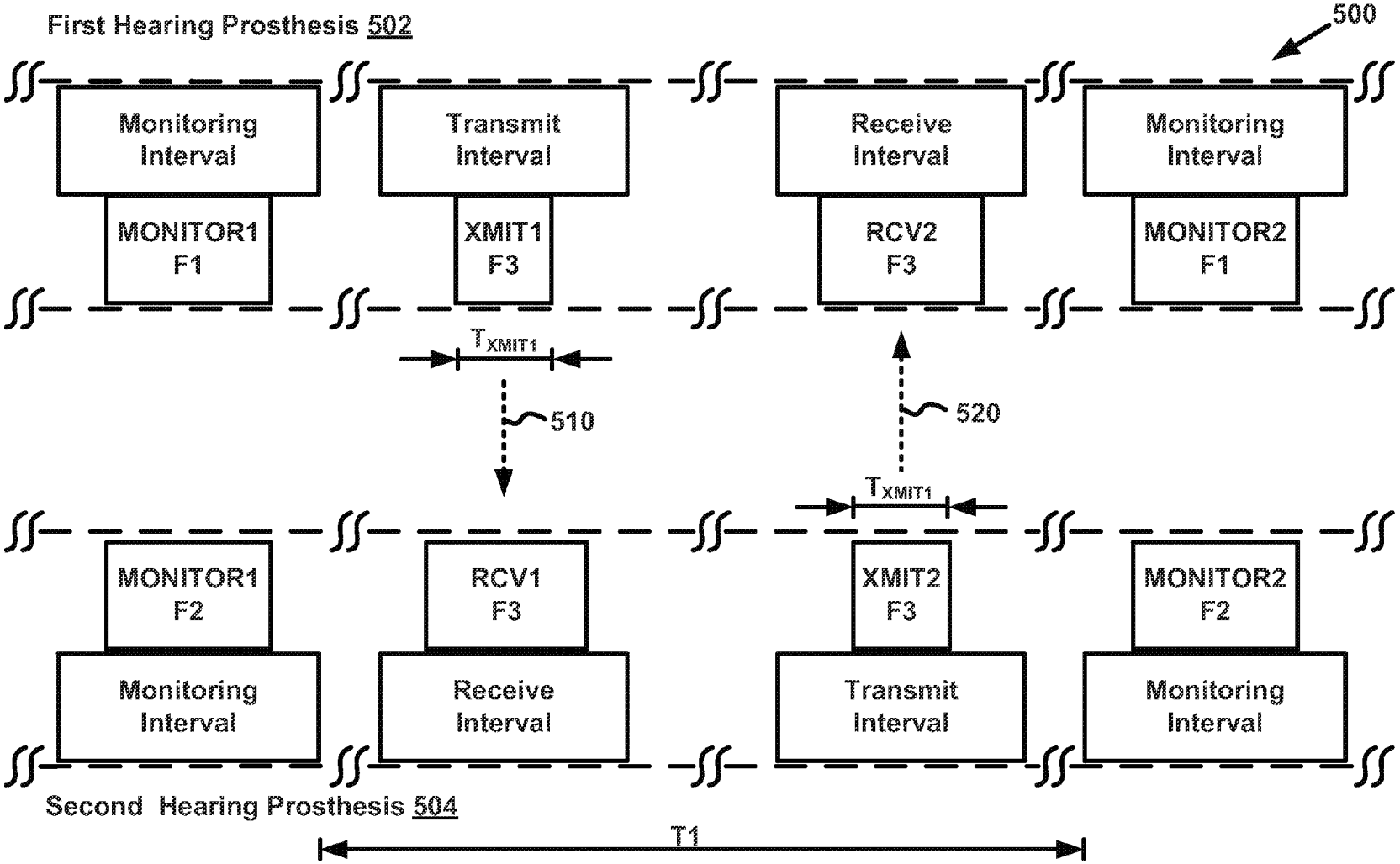
FIGS. 5A-5B are timing diagrams for bilateral communication between two hearing prosthesis utilizing the method depicted in FIG. 4, according to an example.
Figure 5B:
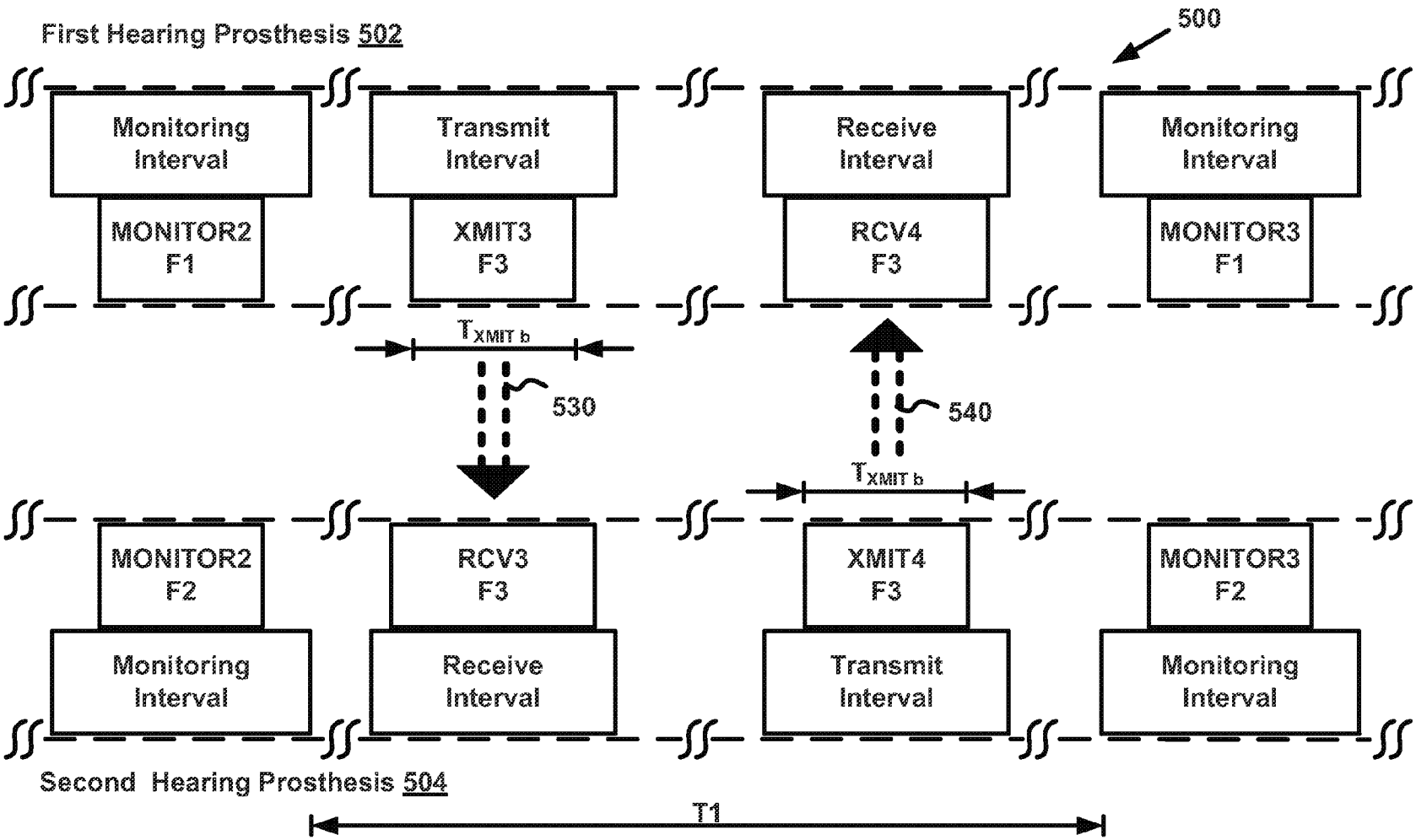

FIG. 5 is a timing diagram 500 split into FIGS. 5A-5B for clarity. FIG. 5A illustrates a first cycle of bilateral communications between a first hearing prosthesis 502 and a second hearing prosthesis 504 interleaved with communications with a remote device (not shown) utilizing the method 400. In one example, the first hearing prosthesis 502 and the second hearing prosthesis 504 are the first hearing prosthesis 102 and the second hearing prosthesis 104 depicted in FIG. 1, respectively. Additionally, the remote device is the remote device 106 depicted in FIG. 1.

In the example illustrated in the timing diagram 500, one cycle of the method 400 for the first hearing prosthesis 502 includes performing the following sequence: block 402—block 404—block 406. One cycle of the method 400 for the second hearing prosthesis 504 includes performing the following sequence: block 402—block 406—block 404. Performing the steps of the method 400 in this arrangement synchronizes the transmit interval of the first hearing prosthesis 502 with the receive interval of the second hearing prosthesis 504 and the transmit interval of the second hearing prosthesis 504 with the receive interval of the first hearing prosthesis 502.

The timing diagram 500 includes monitoring intervals interleaved with transmit and receive intervals. The spacing of the monitoring intervals is determined by the remote device. In the illustrated example, the monitoring intervals are spaced at a first time interval T1. Thus, once a current monitoring interval ends, a next monitoring interval begins after the first time interval T1 has elapsed.

In the example illustrated in FIG. 5A, a transceiver for each of the hearing prostheses 502, 504 is on for a period of time within each interval. The period of time in which the transceivers are activated depends on the amount of data being transferred to or from one of the hearing prostheses 502, 504; as more data is transmitted or received, the transceiver is activated for a longer period of time. Adapting the amount of time in which the transceivers are activated to the amount of data transmitted or received reduces the amount of power and bandwidth used by the hearing prostheses 502, 504 during intervals in which the amount of data transmitted or received is low.

The length of a monitoring period is determined by the remote device. In one example, the remote device includes the length of the next monitoring period in the first packet transmitted during a current monitoring period. The period of time in which the transceivers are on during a transmit interval or a receive interval is determined by the first hearing prosthesis 502. In one example, the first hearing prosthesis 502 includes an indication of a length of a next transmit period and a next receive period in the payload of a data packet transmitted during a current transmit period. In another example, the lengths of the transmit period and the receive period depend on the data rate indicated in the first packet transmitted by the first hearing prosthesis 502.

The timing diagram 500 depicts the first hearing prosthesis 502 and the second hearing prosthesis 504 monitoring for a remote signal from the remote device during a first monitoring period (MONITOR1). The first hearing prosthesis 502 monitors for the remote signal on a first frequency F1. The second hearing prosthesis 504 monitors for the remote signal on a second frequency F2.

Next, the first hearing prosthesis 502 transmits a first bilateral signal 510 during a first transmit period (XMIT1), and the second hearing prosthesis receives the first bilateral signal 510 during a first receive period (RCV1). The first hearing prosthesis 502 transmits the first bilateral signal 510 on a third frequency F3 at a first bilateral data rate. In one example, the third frequency F3 includes a subset of frequencies reserved for bilateral communications between the first hearing prosthesis 502 and the second hearing prosthesis 504. A first data packet in the first bilateral signal 510 includes a bilateral data rate for a next communication cycle. An additional data packet included in the first bilateral signal 510 may include a frequency, timing information, or additional information for the next communication cycle.

After a second time interval T2, the second hearing prosthesis 504 transmits a second bilateral signal 520 during a second transmit period (XMIT2), and the first hearing prosthesis 502 receives the second bilateral signal 520 during a second receive period (RCV2). The second hearing prosthesis 504 transmits the second bilateral signal 520 at the first bilateral data rate. Once the second transmit interval and the second receive interval expire, the hearing prostheses 502, 504 have completed one cycle of the method 400. The hearing prostheses 502, 504 begin a second cycle of the method 400 by monitoring for the remote signal from the remote device during a second monitoring period (MONITOR2).

FIG. 5B illustrates a second cycle of interleaved bilateral communications between the first hearing prosthesis 502 and the second hearing prosthesis 504 utilizing the method 400. The second cycle occurs after the first cycle depicted in FIG. 5A and is shown as commencing with the second monitoring period (MONITOR2). After the second monitoring period (MONITOR2), the first hearing prosthesis 502 transmits a third bilateral signal 530 to the second hearing prosthesis 504 during a third transmit period (XMIT3). If the first hearing prosthesis 502 included a new bilateral data rate in the first bilateral signal 510, the third bilateral signal 530 represents a first bilateral communication at the new bilateral data rate.

For instance, consider a situation in which the hearing prostheses 502, 504 communicate using the first bilateral data rate. When using the first bilateral data rate, each transmit period has a first duration ($T_{XMIT1}$), as depicted in FIG. 5A. The first hearing prosthesis 502 determines a second bilateral data rate for bilateral communications prior to the first transmit period (XMIT1) and includes the second bilateral data rate in the payload of the first data packet included in the first bilateral signal 510. The second hearing prosthesis 504 receives the first bilateral signal 510 and identifies the second bilateral data rate from the payload of the first data packet included in the first bilateral signal 510. The second hearing prosthesis 504 transmits the second bilateral signal 520 at the first bilateral data rate.

When using the second bilateral data rate, each transmit period has a second duration ($T_{XMIT2}$). At the third transmit period (XMIT3), the first hearing prosthesis 502 transmits the third bilateral signal 530 at the second bilateral data rate, and the second hearing prosthesis 504 receives the third bilateral signal 530 during a third receive period (RCV3). After a third time interval T3, the second hearing prosthesis 504 transmits a fourth bilateral signal 540 at the second bilateral data rate during a fourth transmit period (XMIT4), and the first hearing prosthesis 502 receives the fourth bilateral signal 540 during a fourth receive period (RCV4).

After the fourth transmit period (XMIT4) and the fourth receive period (XMIT4), the hearing prostheses monitor for a signal from the remote device during a third monitoring period (MONITOR3). The second monitoring interval (MONITOR2) and the third monitoring interval (MONITOR3) are separated by the first time interval T1. The hearing prostheses 502, 504 continue to conduct bilateral communications using the second bilateral data rate until the first hearing prosthesis 502 determines a third bilateral data rate or until the bilateral communication link is disestablished.

In the example illustrated in FIG. 5B, the second bilateral data rate is greater than the first bilateral data rate. Because the second bilateral data rate is greater than the first data rate, more time is needed to transmit the third bilateral signal 530 and the fourth bilateral signal 540 than is needed to transmit the first bilateral signal 510 and the second bilateral signal 520. Thus, the second duration ($T_{XMIT2}$) is greater than the first duration ($T_{XMIT1}$). In an example where the second bilateral data rate is twice the first bilateral data rate, the second duration ($T_{XMIT2}$) is about twice as long as the first duration ($T_{XMIT1}$).

Returning to FIG. 1, in another example the first hearing prosthesis 102 changes the bilateral data rate by changing a frequency of bilateral signals transmitted during each communication cycle. In this example, an amount of data included in each bilateral signal is about the same; the symbol rate for each bilateral signal and the number of packets included in each bilateral signal is about the same.

In this example, the maximum number of bilateral data packets transmitted during one communication cycle is given by the following equation:

$$\text{Maximum Number of Packets}=T_{int1}/T_{in2}+T_{XMIT})$$

where $T_{int1}$ is a first time interval between a first monitoring period and a second monitoring period, $T_{int2}$ is a second time interval between a transmit period and receive period at a bilateral data rate, and $T_{XMIT}$ is a duration of a transmission of a bilateral signal. To accommodate a change in the frequency of transmission of bilateral signals, a length of the second time interval is inversely proportional to the change in the bilateral data rate. As the bilateral data rate increases, a length of the second time interval decreases, and as the bilateral data rate decrease, the length of the second time interval increases.

Figure 6A:
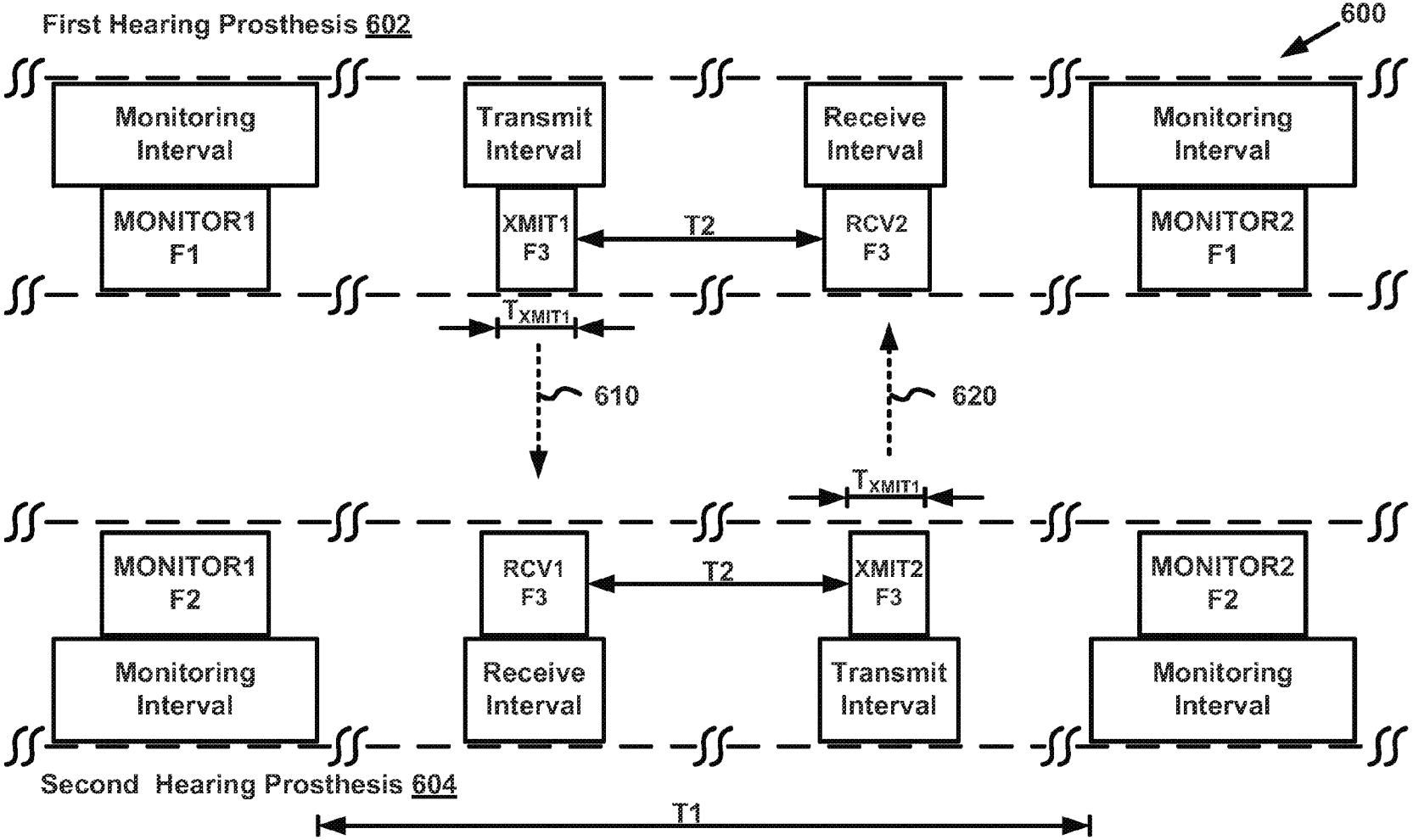
FIGS. 6A-6B are additional timing diagrams for bilateral communication between two hearing prostheses utilizing the method depicted in FIG. 4, according to an example.
Figure 6B:
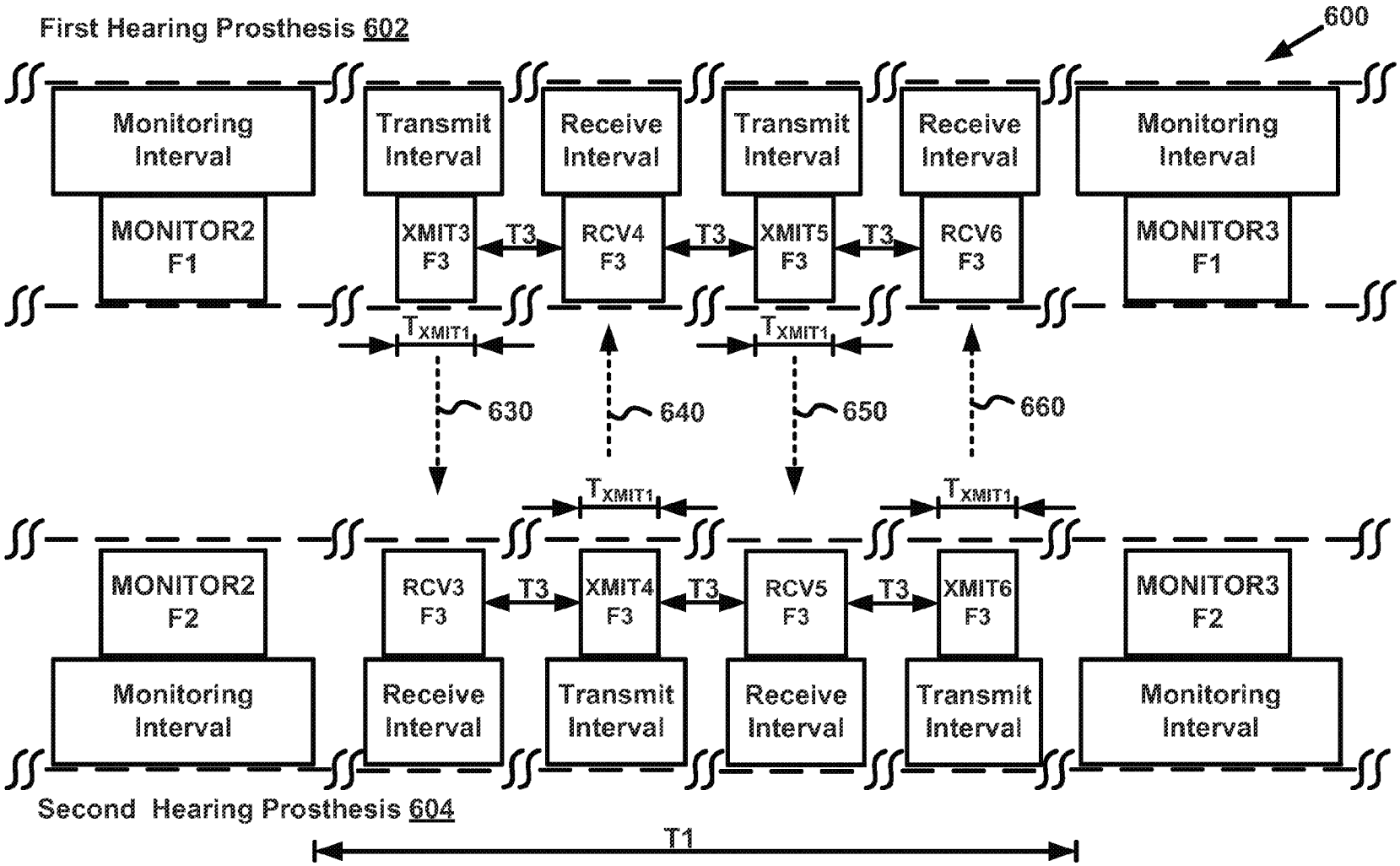

FIG. 6 is a timing diagram 600 split into FIGS. 6A-6B for clarity. FIG. 6A illustrates a first cycle of bilateral communications between a first hearing prosthesis 602 and a second hearing prosthesis 604 a first bilateral data rate interleaved with communications with a remote device (not shown) utilizing the method 400. The first hearing prosthesis 602 and the second hearing prosthesis 604 are the same as or substantially similar to the first hearing prosthesis 502 and the second hearing prosthesis 504 depicted in FIGS. 5A-5B, respectively. Additionally, a portion of the timing diagram 600 depicted in FIG. 6A is the same as or substantially similar to the portion of the timing diagram 500 depicted in FIG. 5A, and bilateral signals 610, 620 are the same as or substantially similar to the bilateral signals 510, 520. For each of the hearing prostheses 602, 604, a second time interval T2 separates a transmit interval from a receive interval when the hearing prostheses 602, 604 communicate using the first bilateral data rate.

In the timing diagram 500, the length of the third transmit period (XMIT3) and the fourth transmit period (XMIT4) is increased to accommodate an increase in the bilateral data rate. In the timing diagram 600, a length of the transmit periods ($T_{XMIT}$) is about constant at the first bilateral data rate and at a second bilateral data rate. Thus, changing the bilateral data rate changes a number of bilateral signals transmitted between monitoring periods by the hearing prostheses 602, 604. For example, if the second bilateral data rate is greater than the first bilateral data rate, more data packets are transmitted by the hearing prostheses 602, 604 at the second data rate than at the first data rate.

In one example, the second bilateral data rate is twice the first data rate. In order to increase the frequency of the transmit intervals and receive intervals, each of the hearing prostheses 602, 604 performs the steps of blocks 404, 406 twice during each cycle of the method 400. For instance, one cycle of the method 400 for the first hearing prosthesis 602 includes performing the following sequence: block 402—block 404—block 406—block 404—block 406. Likewise, one cycle of the method 400 for the second hearing prosthesis 604 includes performing the following sequence: block 402—block 406—block 404—block 406—block 404. In another example, the hearing prostheses 602, 604 perform additional or fewer iterations of the steps of blocks 404, 406 in between monitoring periods depending on the bilateral data rate determined by the first hearing prosthesis 602.

FIG. 6B illustrates a second cycle of bilateral communications between the first hearing prosthesis 602 and the second hearing prosthesis 604 at a second bilateral data rate interleaved with communication with the remote device. For illustrative purposes, the second bilateral data rate is twice the first bilateral data rate. The first hearing prosthesis 602 includes the second bilateral data rate in the first packet of a first bilateral signal, such as the first bilateral signal 610.

The first hearing prosthesis 602 transmits a third bilateral signal 630 during a third transmit period (XMIT3). The second hearing prosthesis 604 receives the third bilateral signal 630 during a third receive period (RCV3). The second hearing prosthesis 604 transmits a fourth bilateral signal 640 during a fourth transmit period (XMIT4), and the first hearing prosthesis 602 receives the fourth bilateral signal 640 during a fourth receive period (RCV4).

Next, the first hearing prosthesis 602 transmits a fifth bilateral signal 650 during a fifth transmit interval (XMIT5) that is received by the second hearing prosthesis 604 during a fifth receive interval (RCV5). The second hearing prosthesis 604 then transmits a sixth bilateral signal 660 during a sixth transmit period (XMIT6) that is received during a sixth receive period (RCV6) by the first hearing prosthesis 602. At the second bilateral data rate, the transmit periods and the receive periods for each of the hearing prostheses 602, 604 are separated by a third time interval T3. Because the second bilateral data rate is greater than the first bilateral data rate, the second time interval T2 is greater than third time interval T3.

After the sixth transmit period (XMIT6) and the sixth receive period (RCV6) have ended, the hearing prostheses 602, 604 have completed the second bilateral communication cycle. The second monitoring interval (MONITOR2) and the third monitoring interval (MONITOR3) are also separated by the first time interval T1. The hearing prostheses 602, 604 continue to conduct bilateral communications between monitoring intervals at the second bilateral data rate as described by the timing diagram 600 until the first hearing prostheses 602 determines a third bilateral data rate or the bilateral communication link is disestablished.

Returning to FIG. 1, in an additional example, the first hearing prosthesis 102 changes the symbol rate of bilateral signals sent between the hearing prostheses 102, 104 when changing the bilateral data rate. In yet another example, the first hearing prosthesis 102 employs a combination of the examples for adjusting the bilateral data rate for communications between the hearing prostheses 102, 104 via the first communication channel. For instance, the first hearing prosthesis 102 may change the bilateral data rate by adjusting the frequency of bilateral signal transmissions and the length of the transmit periods. In still another example, the first hearing prosthesis 102 employs any method or algorithm now known or later discovered that is suitable for adjusting the bilateral data rate.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method comprising:

determining, by a first hearing prosthesis prior to a first transmission interval, a data rate to be used by the first hearing prosthesis and a second hearing prosthesis during a second transmission interval, wherein the determined data rate is based on an acoustic environment in which the first hearing prosthesis and the second hearing prosthesis operate, and wherein the first hearing prosthesis and the second hearing prosthesis are bilateral hearing prostheses;

based on the determined data rate, determining by the first hearing prosthesis at least one of (i) a payload length for each data packet transmitted during the second transmission interval or (ii) a length of the second transmission interval;

during the first transmission interval, transmitting from the first hearing prosthesis to the second hearing prosthesis a first signal that includes an indication of the determined data rate, wherein the indication of the determined data rate comprises an indication of at least one of (i) the payload length for each data packet transmitted during the second transmission interval or (ii) the length of the second transmission interval; and transmitting a second signal from the second hearing prosthesis to the first hearing prosthesis during the second transmission interval, wherein the second hearing prosthesis transmits the second signal at the determined data rate for the second transmission interval.

2. The method of claim 1, wherein the first signal and the second signal each include at least one data packet.

3. The method of claim 2, wherein the first signal includes a first data packet having a first payload, wherein the indication of the determined data rate is included in the first payload.

4. The method of claim 3, wherein the first payload includes a symbol rate for transmissions sent from the second hearing prosthesis, wherein the symbol rate is based on the determined data rate.

5. The method of claim 1, further comprising:

receiving, by the first hearing prosthesis, a third signal from a remote device during a first monitoring interval; and receiving, by the second hearing prosthesis, a fourth signal from the remote device during a second monitoring interval, wherein the first transmission interval and the second transmission interval are interleaved with the first monitoring interval and the second monitoring interval.

6. The method of claim 5, wherein a symbol rate of the first signal and the second signal is less than a symbol rate of the third signal and the fourth signal.

7. The method of claim 1, wherein the first signal and the second signal include information for synchronizing a setting of a parameter used by the first hearing prosthesis and the second hearing prosthesis to process a sound.

8. A system comprising:

a first hearing prosthesis;

a second hearing prosthesis, wherein the first hearing prosthesis and the second hearing prosthesis are bilateral hearing prostheses; and a remote device, wherein a first set of communications between the first hearing prosthesis and the second hearing prosthesis is interleaved with (i) a second set of communications between the remote device and the first hearing prosthesis and (ii) a third set of communications between the remote device and the second hearing prosthesis, and wherein the first hearing prosthesis determines, based on an acoustic environment in which the bilateral hearing prosthesis operate, (i) a data rate used by the bilateral prostheses for the first set of communications and, based on the determined data rate, (ii) at least one of (a) a payload length of each data packet included in the first set of communications or (b) an amount of time between communications in the first set of communications.

9. The system of claim 8, wherein a symbol rate of the first set of communications is less than a symbol rate of the second set of communications and the third set of communications.

10. The system of claim 8, wherein the first set of communications includes:

a first interval in which the first hearing prosthesis sends a first signal to the second hearing prosthesis; and a second interval in which the second hearing prosthesis sends a second signal to the first hearing prosthesis, wherein the first signal and the second signal are digitally modulated signals.

11. The system of claim 10, wherein M frequencies are available for transmitting the first set of communications, the second set of communications, and the third set of communications, wherein N frequencies of the M frequencies are reserved for the first set of communications, and wherein M and N are integers.

12. The system of claim 10, wherein the first hearing prosthesis is configured to select a transmit frequency for the second signal from the N frequencies reserved for the first set of communications, wherein the first hearing prosthesis includes an indication of the transmit frequency in the first signal.

13. The system of claim 8, wherein the first hearing prosthesis transmits to the second hearing prosthesis a first communication included in the first set of communications, the first communication comprising information indicative of at least one of (i) the payload length of each data packet included in the first set of communications or (b) the amount of time between the communications in the first set of communications.

14. A hearing prosthesis comprising a transceiver and one or more processor configured to:

identify an operating mode of the hearing prosthesis based on an acoustic environment in which the hearing prosthesis and an additional hearing prosthesis operate;

determine, based on the operating mode, a data rate for a next communication cycle, wherein the data rate is used by the hearing prosthesis and the additional hearing prosthesis to transmit signals during the next communication cycle;

based on the determined data rate, determine at least one of (i) a length of each transmission interval during the next communication cycle or (ii) an amount of time between each transmission interval during the next communication cycle; and transmit a signal to the additional hearing prosthesis via the transceiver that includes information indicative of the determined data rate for the next communication cycle, wherein the information indicative of the determined data rate comprises information indicative of at least one of (i) a length of each transmission interval during the next communication cycle or (ii) an amount of time between each transmission interval during the next communication cycle.

15. The hearing prosthesis of claim 14, wherein the one or more processors are further configured to include the information indicative of the determined data rate in a payload of a first data packet included in the signal.

16. The hearing prosthesis of claim 15, wherein the one or more processors are further configured to send the first data packet to the additional hearing prosthesis before any additional data packets during the transmission interval.

17. The hearing prosthesis of claim 15, wherein the one or more processors are further configured to determine, based on the determined data rate, a payload length of one or more data packets for the next communication cycle.

18. The hearing prosthesis of claim 17, wherein the information indicative of the determined data rate for the next communication cycle further includes the length of the payload of the one or more data packets.

19. The hearing prosthesis of claim 14, further comprising an audio transducer configured to receive a sound and generate a sound signal that includes information indicative of the sound, wherein the one or more processors are further configured to:

receive the sound signal from the audio transducer; and determine the acoustic environment based on at least the sound signal.

* * * * *